US006254787B1

(12) United States Patent
Kimura et al.

(10) Patent No.: US 6,254,787 B1
(45) Date of Patent: Jul. 3, 2001

(54) METHOD FOR ESTABLISHING A FLUID CONTAINING SIZE-CONTROLLED PARTICLES

(75) Inventors: Masao Kimura, Minato-machi; Itsuko Suzuki, Matsudo; Kohei Tarutani, Tsukuba, all of (JP)

(73) Assignee: L'Air Liquide, Societe Anonyme pour l'Etude et l'Exploitation des Procedes Georges Claude, Paris (FR)

( * ) Notice: Subject to any disclaimer, the term of this patent is extended or adjusted under 35 U.S.C. 154(b) by 0 days.

(21) Appl. No.: 09/294,132

(22) Filed: Apr. 20, 1999

(30) Foreign Application Priority Data

Apr. 30, 1998 (JP) ..... 10-121505

(51) Int. Cl.[7] ..... B03C 3/017

(52) U.S. Cl. ..... 210/748; 95/58; 95/68; 95/69; 210/634; 210/785; 209/1; 436/10; 73/1.02; 73/38

(58) Field of Search ..... 73/1.02, 1.03, 73/38, 61.71, 61.72; 95/58, 63, 68, 69, 79; 210/748, 785, 806, 634, 639, 650, 767; 209/1, 132, 133, 155; 436/10

(56) References Cited

U.S. PATENT DOCUMENTS 3,449,938 * 6/1969 Giddings ..... 210/748
4,147,621 * 4/1979 Giddings ..... 210/748
4,214,981 * 7/1980 Giddings ..... 210/748
4,737,268 * 4/1988 Giddings ..... 210/748
4,894,146 * 1/1990 Giddings ..... 210/748
4,894,172 * 1/1990 Williams ..... 210/748

* cited by examiner

*Primary Examiner*—Joseph W. Drodge
(74) *Attorney, Agent, or Firm*—Burns, Doane, Swecker & Mathis, L.L.P.

(57) ABSTRACT

Provided is a method for preparing a fluid containing size-controlled particles that is optimized with respect to use of a target fluid as a matrix fluid under conditions approximating actual conditions. In a preferred embodiment, size-controlled $SiO_2$ particles are obtained by mixing and dispersing $SiO_2$ starting particles having various sizes in a $N_2$ carrier gas followed by fractionation with a fractionator. The size-controlled particles are electrostatically collected by a porous member from the carrier gas flow. Ultrasonic vibrations are then applied to the porous member while a HCl matrix fluid flows through the porous member loaded with the size-controlled particles. This causes release of the size-controlled particles from the porous member and their admixture and dispersion into the HCl matrix fluid.

30 Claims, 2 Drawing Sheets

METHOD FOR ESTABLISHING A FLUID CONTAINING SIZE-CONTROLLED PARTICLES

This application claims priority under 35 U.S.C. §§119 and/or 365 to 121505/1998 filed in Japan on Apr. 30, 1998; the entire content of which is hereby incorporated by reference.

BACKGROUND OF THE INVENTION

1. Field of the Invention

The present invention relates to a method for preparing a fluid containing size-controlled particles, thereby establishing a fluid flow of size-controlled particles in a dispersed state. This type of fluid can be used for the particle size calibration (scale adjustment or correction) of particle measurement instruments and for testing the particle collection performance of filters.

2. Description of the Related Art

Light-scattering particle measurement instruments for measuring microparticles in a gas or liquid must be subjected to a particle size calibration prior to use. Fluids that contain size-controlled particles in a dispersed state are used as the standard fluids in these calibrations, and monodispersed particles whose size distribution essentially presents a single peak are used as the size-controlled particles in these standard fluids.

The standard fluids used for the calibration of light-scattering instruments for measuring the particles in a gas typically consist of inert gases containing monodispersed particles of polystyrene latex (PSL). More specifically, standard fluids of this type typically comprise gaseous fluids prepared by spraying a commercially available liquid containing monodispersed PSL particles into an inert gas flow at around atmospheric pressure. Water containing dispersed PSL monodispersed particles is generally employed as the standard fluid for calibrating light-scattering instruments for measuring particles in a liquid.

The particle collection performance of particle-removing filters is tested by passing a standard fluid—in this case a gas containing size-controlled particles in a dispersed state—through the filter. The size-controlled particles used in tests of this type take the form of polydispersed particles whose size distribution essentially presents a plural number of peaks. The use of polydispersed particles and the measurement of the number of particles exiting the filter enables calculation of the collection efficiency at various particle sizes in a single procedure.

The standard fluid (gas) employed in the testing of the particle collection performance of filters typically consists of polydispersed particles of, for example, dioctyl phthalate (DOP) or triphenyl phosphate (TPP), dispersed in $N_2$ gas. Standard fluids of this type are prepared by spraying an aqueous solution containing the DOP or TPP into a flow of $N_2$ gas at around atmospheric pressure.

In order to achieve higher measurement accuracies with light-scattering particle measurement instruments, the calibration must be run under conditions approximating actual conditions using the target fluid (i.e., the fluid that will ultimately be subjected to measurement) as the matrix fluid of the calibrating standard fluid. When, for example, the target fluid is a gas such as HCl, HBr, $SiH_4$, $PH_3$, or $B_2H_6$, one is dealing with reactive gases whose pressure during measurement is typically substantially higher than atmospheric pressure. When the target fluid is a liquid such as $H_2O_2$, $NH_4OH$, trichloroethylene, or xylene, one is dealing with liquids whose refractive index is different from that of water, which prevents accurate particle size measurement when water is used for calibration. Similarly, in the case of particle-removing filters, in order to obtain agreement between the performance data acquired by testing and the performance data during actual use, the testing must be run under conditions approximating actual conditions using the target fluid (i.e., the fluid that will ultimately be filtered) as the matrix fluid of the standard fluid used for particle collection performance testing.

The use of the target fluid as the matrix fluid under conditions approximating actual conditions causes the following problems for the procedures heretofore used to prepare a fluid containing size-controlled particles. When the target fluid is a reactive fluid, the size-controlled particles can react with the reactive matrix fluid, which can lead to changes in the particle sizes and to the admixture of reaction products into the matrix fluid. In addition, the admixture/dispersion of size-controlled particles into the fluid by spraying results in the admixture of the spray gas into the matrix fluid and hence in a shift in composition. Moreover, this admixture/dispersion method cannot be used when the target fluid is a compressed gas.

The present invention was developed in view of the aforedescribed problems of the prior art. The object of the present invention is to provide a method for establishing a fluid containing size-controlled particles that has been optimized with respect to use of the target fluid as the matrix fluid under conditions approximating actual conditions.

SUMMARY OF THE INVENTION

In a first aspect of the present invention, there is provided a method for preparing or establishing a fluid containing size-controlled particles. Also provided is a method for establishing a fluid flow of size-controlled particles and its use in calibration applications. The method for preparing the fluid comprises

- a predispersion process in which starting particles having various sizes and comprising a material inert to the matrix fluid are mixed and dispersed into a high-purity carrier gas that is inert with respect to said starting particles,
- a fractionation process in which size-controlled particles are obtained by fractionating said starting particles by passing a flow of the starting particle-loaded carrier gas through a dry-process fractionator,
- a collection process in which a flow of the carrier gas loaded with the now size-controlled particles is passed through a porous member in order to collect said size-controlled particles on said porous member, with said porous member comprising a material inert with respect to the matrix fluid, and effecting an electrostatic particle collection, and
- a main dispersion process in which said size-controlled particles are released from the porous member and mixed and dispersed into the matrix fluid by passing a flow of said matrix fluid through the porous member loaded with the size-controlled particles while at the same time applying ultrasonic vibrations to said porous member.

A second aspect of the present invention is characterized by using the aforesaid fractionator in the method of the first aspect to carry out an electrostatic fractionation of the starting particles.

A third aspect of the present invention is characterized by the porous member in the methods of the first and second aspects being a filter with a pore size that is substantially larger than the size-controlled particles.

A fourth aspect of the present invention is characterized by the use of spraying to mix and disperse the starting particles into the carrier gas in the predispersion process of any of the methods according to the first to third aspects.

A fifth aspect of the present invention is characterized by the application of the ultrasonic waves as pulses with a width of 1 msec. to 10 seconds and an interval of 100 msec. to 100 seconds in any of the methods according to the first to fourth aspects.

A sixth aspect of the present invention is characterized by the matrix fluid in any of the methods according to the first to fifth aspects being a reactive gas selected from the group consisting of $SiH_4$, $PH_3$, $B_2H_6$, $AsH_3$, $SiCL_2H_2$, $H_2$, HCl, $Cl_2$, HF, $F_2$, HBr, $Br_2$, HI, $NH_3$, $CH_4$, $C_2H_2$, $C_2H_4$, $C_2H_6$, $C_3H_8$, $C_4H_{10}$, NO, $NO_2$, $N_2O$, CO, and $O_2$.

A seventh aspect of the present invention is characterized by the pressure of the aforesaid reactive gas matrix fluid in the method of the sixth aspect being higher than atmospheric pressure.

An eighth aspect of the present invention is characterized by the use of a liquid selected from the group consisting of water, hydrochloric acid, nitric acid, hydrogen fluoride, aqueous ammonia, hydrogen peroxide, acetic acid, sulfuric acid, phosphoric acid, hydrofluoric acid, ammonium fluoride solutions, propanol, acetone, ethanol, methanol, trichloroethylene, tetrachloroethylene, methyl ethyl ketone, toluene, xylene, trichloroethane, methyl ethyl ketone, hexamethyldisilazane, and dichloromethane as the matrix fluid in any of the methods according to the first to fifth aspects.

A characteristic feature of the ninth aspect of the present invention is that the size distribution of the size-controlled particles in any of the methods according to the first to eighth aspects essentially presents a single peak.

A characteristic feature of the tenth aspect of the present invention is that the size distribution of the size-controlled particles in any of the methods according to the first to eighth aspects essentially presents a plural number of peaks.

The fluid containing size-controlled particles made according to the present invention can then be used as the standard fluid in particle size calibrations and in the particle collection performance testing of filters.

Figure 1:
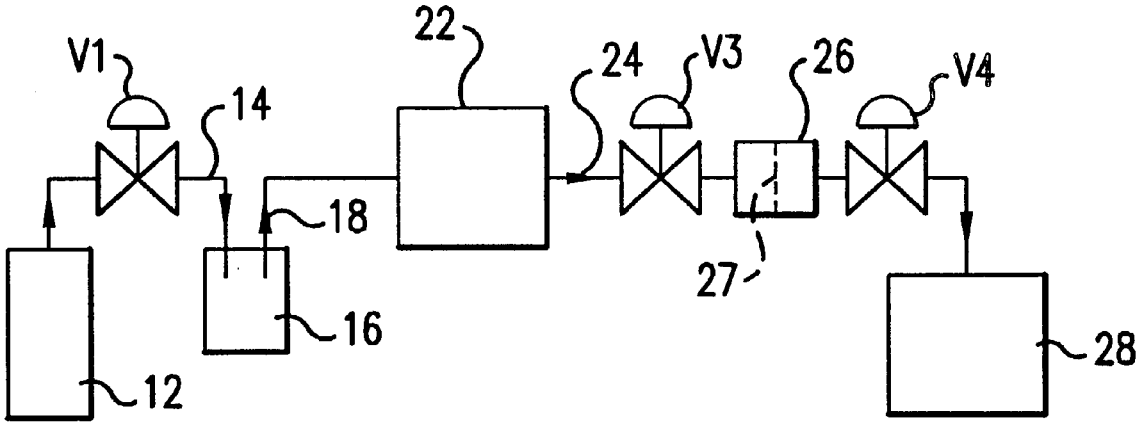
FIG. 1 contains a schematic diagram of the first half of an embodiment of the method according to the present invention for preparing a fluid of size-controlled particles.

The following reference numbers are used throughout the Figures of the Drawings:

12 carrier gas source
16 starting particle source
22 fractionator
26 collector
27 porous member
28 exhaust system
42 matrix fluid source
45 filter
54 laser particle counter
56 flow controller
58 exhaust system
62 sound coupler
64 ultrasonic oscillator
66 high-frequency power source

DETAILED DESCRIPTION OF THE PREFERRED EMBODIMENTS

In the explanation that follows, constituent elements having approximately the same structure and function carry the same reference number and their explanation will be repeated only when necessary.

Referring to FIG. 1, a valve V1-equipped feed conduit 14 is connected to the outlet of a gas source 12 that can supply a carrier gas, e.g., ultrapure $N_2$ gas, at around atmospheric pressure. This feed conduit 14 is connected to a starting particle source 16 for the introduction of starting particles with various sizes into the carrier gas. The starting particles should be composed of a material that is inert to the matrix fluid of the fluid flow that will ultimately be used, for example, the starting particles can be $SiO_2$ when the matrix fluid will be HCl. This particle source 16 is structured in such a manner that a liquid, e.g., pure water, containing the starting particles can be admixed and dispersed into the carrier gas by spraying.

The starting particle-loaded carrier gas is then introduced through feed conduit 18 into a dry-process fractionator 22 that fractionates the starting particles. Devices that electrostatically fractionate the starting particles can be used as the fractionator 22, for example, an Electrostatic Aerosol Fractionator 3071A from Kanomax Japan Inc.

A collector 26 that collects the particles after fractionation is connected across valves V3 and V4 to the outlet conduit 24 of the fractionator 22 in a freely attachable/detachable manner. The outlet conduit 24 is connected downstream from the collector 26 to an exhaust system 28. The interior of the collector 26 contains a porous member 27 capable of electrostatic particle collection. The casing and porous member 27 comprising the collector 26 should be made of materials that are inert to the matrix fluid of the fluid flow that will ultimately be established. For example, the porous member 27 can be a stainless steel (SUS316) filter for ultrahigh purity gas applications that has a pore size substantially larger than the size-controlled particles (discussed below).

The procedure implemented by the structure depicted in FIG. 1 is carried out continuously while a carrier gas such as $N_2$ gas flows from the gas source 12 to the exhaust system 28. The procedure under consideration, which makes up the first half of the subject embodiment of the method according to the present invention for establishing a fluid of size-controlled particles, corresponds to the predispersion, fractionation, and collection processes.

In the predispersion process the aforementioned $SiO_2$ starting particles are sprayed from the particle source 16 into the carrier gas residing approximately at atmospheric pressure from the gas source 12. This results in admixture and dispersion of the starting particles into the carrier gas and their entrained flow with the carrier gas.

In the fractionation process the starting particle-loaded carrier gas is passed through the fractionator 22, which results in fractionation of the starting particles and the production of size-controlled particles. The size-controlled particles to which the invention is directed are microparticles with diameters of from about 3 nm to about 100 $\mu$m.

Only a single fractionation procedure is run when the size-controlled particles must take the form of monodispersed particles whose size distribution essentially presents only a single peak. The fractionation procedure is run a number of times when the size-controlled particles must take the form of polydispersed particles whose size distribution essentially presents a plural number of peaks.

In the collection process, the size-controlled particles are collected on the porous member 27 by passage of the carrier gas, at this point loaded with size-controlled particles, through the porous member 27. The size-controlled particles are electrostatically adsorbed onto the porous member 27 in this process.

Figure 2:
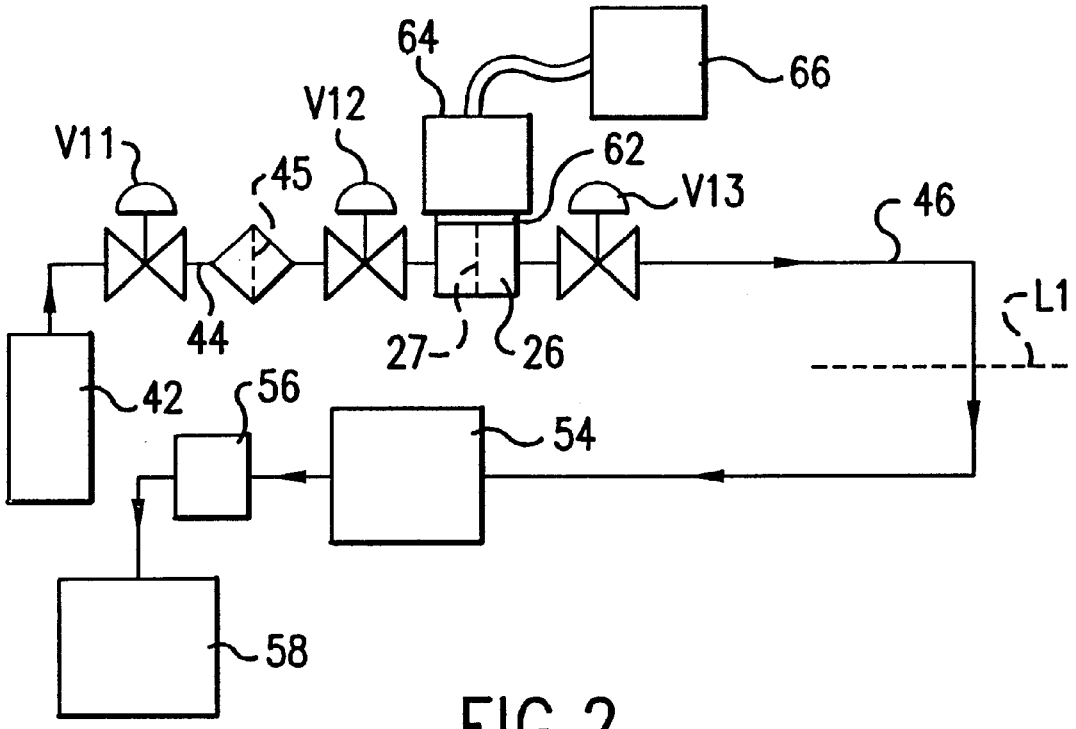
FIG. 2 contains a schematic diagram that illustrates the second half of the embodiment of the method according to the present invention for preparing a fluid of size-controlled particles and which also illustrates a method for utilizing the fluid thereby established.

Once the collector 26 has collected the size-controlled particles in the manner described above, the collector 26 is detached from the outlet conduit 24 and is transferred and installed into the structure depicted in FIG. 2.

Referring to FIG. 2, the valve V11-equipped feed conduit 44 is connected to the outlet of a gas source 42 that can supply a reactive matrix fluid, e.g., HCl gas, at a pressure above atmospheric pressure, e.g., at 6 kg/cm$^2$. A filter 45 is provided in the feed conduit 44 in order to prevent contamination by particles from the gas source 42. The type of filter used for this filter 45 can be the same type as the porous member 27 in the collector 26, i.e., a stainless steel (SUS316) filter for ultrahigh purity gas applications. The collector 26, after performing its function as depicted in FIG. 1, is connected in the feed conduit 44 across the valves V12 and V13 again in a freely attachable/detachable manner.

A laser particle counter 54 is provided in the outlet conduit 46 from the valve V13 in order to implement size calibration of this light-scattering particle measurement instrument using the fluid flow containing size-controlled particles as the standard fluid. This laser particle counter 54 is connected to an exhaust system 58 across a flow controller 56.

An ultrasonic oscillator 64 is provided—across an intervening sound coupler 62—on the external wall of the casing of the collector 26. A tacky material such as, for example, jelly, can be used as this sound coupler 62. The oscillator 64 is provided with a horn that amplifies the vibration of the sound waves, and the tip of this horn is attached to the collector 26 across the sound coupler 62. The oscillator 64 is driven by a high-frequency power source 66 and generates ultrasonic waves with a frequency from 20 kHz to 1 MHZ.

The procedure implemented by the structure depicted in FIG. 2 is carried out continuously while a matrix fluid such as HCl gas flows from the gas source 42 to the exhaust system 58. The procedure under consideration corresponds to the main dispersion process that makes up the second half of the subject embodiment of the method according to the present invention for establishing a fluid that contains size-controlled particles and to a method for utilizing the fluid flow thereby established. The main dispersion process resides upstream from the dot-and-dashed line L1, while the method that utilizes the fluid flow resides downstream from this line.

In this main dispersion process, ultrasonic vibrations from oscillator 64 are applied to the porous member 27 while the pressurized matrix fluid flows from the gas source 42 through the porous member 27 on which the size-controlled particles have been previously collected. This causes release of the size-controlled particles from the porous member 27 and their entry and dispersion into the matrix fluid. In specific terms, a fluid containing size-controlled particles is produced in this embodiment at the outlet conduit 46.

The ultrasonic waves are preferably generated in pulse-form by the oscillator 64 in order to avoid damaging the oscillator 64. Specifically, the width of the ultrasonic pulse should be from 1 msec. to 10 seconds and preferably is from 10 msec. to 100 msec. and the interval should be from 100 msec. to 100 seconds and preferably is from 1 second to 10 seconds. The ultrasonic waves may also be applied to the porous member 27 by, for example, application from a parabolic antenna through vibration of the air or immersion of the collector 26 in a water bath and application through vibration of the water.

After its formation as described above, the fluid loaded with size-controlled particles flows into outlet conduit 46 and is utilized as a standard fluid for particle size calibration when it passes through the laser particle counter 54. In view of the nature of this particular application, the size-controlled particles in the fluid in outlet conduit 46 should take the form of monodispersed particles whose size distribution essentially presents a single peak. In other words, the fractionation process in the procedure illustrated in FIG. 1 should be run only once in order to load the porous member 27 of the collector 26 with monodispersed particles.

The configuration under consideration enables an accurate particle size calibration due to its ability to use the target fluid as the matrix fluid without modification. When, for example, the target fluid is a pressurized reactive gas such as HCl, $AsH_3$, $SiH_4$, $PH_3$, or $B_2H_6$, these target fluids can be used as the matrix fluid under conditions that are essentially identical to the actual measurement conditions. $SiO_2$ is an optimal candidate for the material of the size-controlled particles in the case of these particular target fluids. When the target fluid is a liquid such as $H_2O_2$, $NH_4OH$, or trichloroethylene, these target fluids can again be used as the matrix fluid under conditions that are essentially identical to the actual measurement conditions. With these particular target fluids $Al_2O_3$ is an optimal candidate for the material of the size-controlled particles.

The fluid flow containing size-controlled particles in accordance with the present invention can also be used as the standard fluid for testing the particle collection performance of particle-removing filters. In this application, the size-controlled particles in the fluid in outlet conduit 46 will take the form of polydispersed particles whose size distribution essentially presents a plural number of peaks. In other words, the fractionation process in the procedure illustrated in FIG. 1 should be run a plurality of times in order to load the porous member 27 of the collector 26 with polydispersed particles.

In this particular application the particle-removing filter that is the subject of the test is installed upstream from the particle counter 54 and the particle counter 54 is employed to count the number of particles passing through the particle-removing filter. The use of polydisperse particles enables calculation of the filter's collection efficiency at various particle sizes in a single procedure.

The method according to the present invention for preparing a fluid that contains size-controlled particles is a very widely applicable method and can employ a variety of matrix fluids and starting particles.

For example, the method according to the present invention can use high-purity reactive gases such as $SiH_4$, $PH_3$, $B_2H_6$, $AsH_3$, $SiCl_2H_2$, $H_2$, HCl, $Cl_2$, HF, $F_2$, HBr, $Br_2$, HI, $NH_3$, $CH_4$, $C_2H_2$, $C_2H_4$, $C_2H_6$, $C_3H_8$, $C_4H_{10}$, NO, $NO_2$, $N_2O$, CO, and $O_2$ as its matrix fluid.

The method according to the present invention can also use high-purity inert gases such as $N_2$, Ar, He, Ne, Kr, Xe, and Freon™ as its matrix fluid.

The method according to the present invention can also use high-purity liquids such as water, hydrochloric acid, nitric acid, hydrogen fluoride, aqueous ammonia, hydrogen peroxide, acetic acid, sulfuric acid, phosphoric acid, hydrofluoric acid, ammonium fluoride solutions, propanol, acetone, ethanol, methanol, trichloroethylene, tetrachloroethylene, methyl ,ethyl ketone, toluene, xylene, trichloroethane, methyl isobutyl ketone, hexamethyldisilazane, and dichloromethane as its matrix fluid.

The following can be used, for example, for the starting particles insofar as they are inert with respect to the particular matrix fluid: $SiO_2$, SiC, $Si_3N_4$, $Al_2O_3$, $Cr_2O_3$, $Fe_2O_3$, Si, Fe, Ni, Ta, W, and PSL.

EXAMPLE

Using the set up illustrated in FIG. 1, 2 filter samples (porous member 27) S1 and S2 were prepared by running the procedure in order to collect, respectively, monodispersed $SiO_2$ particles with a peak particle size of 0.30 $\mu$m and monodispersed $SiO_2$ particles with a peak particle size of 0.50 $\mu$m. The filters used for the 2 samples, S1 and S2, were stainless steel (SUS16) filters for ultrahigh purity gas applications.

Each of these filter samples S1 (0.30 $\mu$m) and S2 (0.50 $\mu$m) was installed by itself in feed conduit 44 in the set up illustrated in FIG. 2. HCl gas (pressure=6 kg/cm$^2$) from gas source 42 was employed as the matrix fluid. Ultrasonic waves with a frequency of 27 kHz were applied for about 1 minute from the oscillator 64 while the matrix fluid was flowing at a constant velocity. Ultrasonic pulses with a width of 10 msec. were applied 10 times at an interval of 6 seconds (total of about 1 minute). The size and number of the particles in the fluid flow in the outlet conduit 46 was measured with the laser particle counter 54.

Figure 3:
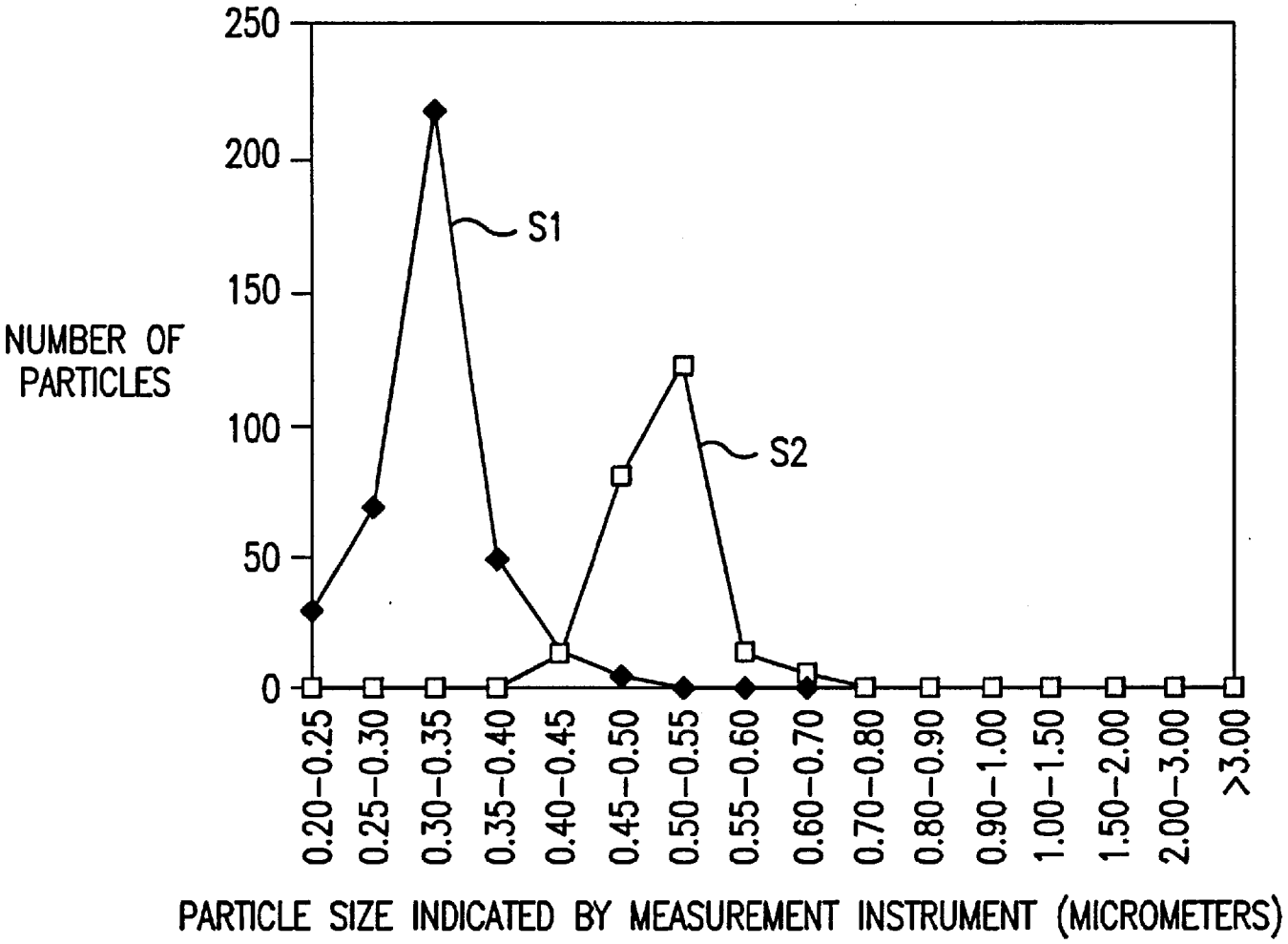
FIG. 3 contains a graph that reports the experimental results from an examination of the particle size distribution curves of the particles in the fluids established by the method illustrated in FIGS. 1 and 2.

FIG. 3 contains a graph that reports the results of the experiments. S1 in the figure designates the particle size distribution curve for filter sample S1, while S2 designates the particle size distribution curve for filter sample S2. These experiments confirmed that size-controlled, monodispersed particles were obtained from both filter sample S1 and filter sample S2.

As has been explained herein above, the method according to the present invention for preparing a fluid containing size-controlled particles allows one to use the target fluid as its matrix fluid under conditions approximating actual conditions. As a result, application of the fluid of size-controlled particles prepared according to the present invention as the standard fluid in particle size calibrations enables and supports improved measurement accuracy by light-scattering particle measurement instruments. Moreover, application of the fluid of size-controlled particles prepared according to the present invention as the standard fluid in the performance testing of the particle collection efficiency of particle-removing filters can bring about better agreement between the performance data acquired during testing and the performance data in actual use.

While the invention has been described with preferred embodiments, it is to be understood that variations and modifications may be resorted to as will be apparent to those skilled in the art. Such variations and modifications are to be considered within the purview and the scope of the claims appended hereto.

What is claimed is:

1. A method for preparing a fluid that contains size-controlled particles, which comprises a predispersion process in which starting particles having various sizes and comprising material inert to a matrix fluid are dispersed into a high-purity carrier gas that is inert with respect to said starting particles, a fractionation process in which size-controlled particles are obtained by fractionating said starting particles by passing a flow of the starting particle-loaded carrier gas through a dry-process fractionator, a collection process in which a flow of the carrier gas loaded with the now size-controlled particles is passed through a porous member in order to collect said size-controlled particles on said porous member, with said porous member comprising a material inert with respect to the matrix fluid and effecting an electrostatic particle collection, and a main dispersion process in which said size-controlled particles are released from the porous member and dispersed into the matrix fluid by passing a flow of said matrix fluid through the porous member loaded with the size-controlled particles while at the same time applying ultrasonic waves to said porous member.

2. The method according to claim 1 for preparing a fluid that contains size-controlled particles, wherein said fractionator executes an electrostatic fractionation of the starting particles.

3. The method according to claim 2, wherein said porous member comprises a filter with a pore size that is substantially larger than said size-controlled particles.

4. The method according to claim 2, wherein the starting particles are dispersed into the carrier gas in the predispersion process by spraying.

5. The method according to claim 2, wherein said ultrasonic waves are applied as pulses with a width of 1 msec. to 10 seconds and an interval of 100 msec. to 100 seconds.

6. The method according to claim 2, wherein the matrix fluid comprises a reactive gas selected from the group consisting of $SiH_4$, $PH_3$, $B_2H_6$, $AsH_3$, $SiCl_2H_2$, $H_2$, HCl, $Cl_2$, HF, $F_2$, HBr, $Br_2$, HI, $NH_3$, $CH_4$, $C_2H_2$, $C_2H_4$, $C_2H_6$, $C_3H_8$, $C_4H_{10}$, NO, $NO_2$, $N_2O$, CO, and $O_2$.

7. The method according to claim 2, wherein said matrix fluid comprises a liquid selected from the group consisting of water, hydrochloric acid, nitric acid, hydrogen fluoride, aqueous ammonia, hydrogen peroxide, acetic acid, sulfuric acid, phosphoric acid, hydrofluoric acid, ammonium fluoride solutions, propanol, acetone, ethanol, methanol, trichloroethylene, tetrachloroethylene, methyl ethyl ketone, toluene, xylene, trichloroethane, methyl iso-butyl ketone, hexamethyldisilazane, and dichloromethane.

8. The method according to claim 2, wherein the size distribution of the size-controlled particles essentially presents a single peak.

9. The method according to claim 2, wherein the size distribution of the size-controlled particles essentially presents a plural number of peaks.

10. The method according to claim 1 for preparing a fluid that contains size-controlled particles, wherein said porous member comprises a filter with a pore size that is substantially larger than said size-controlled particles.

11. The method according to claim 10, wherein said ultrasonic waves are applied as pulses with a width of 1 msec. to 10 seconds and an interval of 100 msec. to 100 seconds.

12. The method according to claim 1 for preparing a fluid that contains size-controlled particles, wherein the starting particles are dispersed into the carrier gas in the predispersion process by spraying.

13. The method according to claim 12, wherein said ultrasonic waves are applied as pulses with a width of 1 msec. to 10 seconds and an interval of 100 msec. to 100 seconds.

14. The method according to claim 1 for preparing a fluid that contains size-controlled particles, wherein said ultrasonic waves are applied as pulses with a width of 1 msec. to 10 seconds and an interval of 100 msec. to 100 seconds.

15. The method according to claim 14, wherein the matrix fluid comprises a reactive gas selected from the group consisting of $SiH_4$, $PH_3$, $B_2H_6$, $AsH_3$, $SiCl_2H_2$, $H_2$, HCl, $Cl_2$, HF, $F_2$, HBr, $Br_2$, HI, $NH_3$, $CH_4$, $C_2H_2$, $C_2H_4$, $C_2H_6$, $C_3H_8$, $C_4H_{10}$, NO, $NO_2$, $N_2O$, CO, and $O_2$.

16. The method according to claim 14, wherein said matrix fluid comprises a liquid selected from the group consisting of water, hydrochloric acid, nitric acid, hydrogen fluoride, aqueous ammonia, hydrogen peroxide, acetic acid, sulfuric acid, phosphoric acid, hydrofluoric acid, ammonium fluoride solutions, propanol, acetone, ethanol, methanol, trichloroethylene, tetrachloroethylene, methyl ethyl ketone, toluene, xylene, trichloroethane, methyl iso-butyl ketone, hexamethyldisilazane, and dichloromethane.

17. The method according to claim 14, wherein the size distribution of the size-controlled particles essentially presents a single peak.

18. The method according to claim 14, wherein characterized in that the size distribution of the size-controlled particles essentially presents a plural number of peaks.

19. The method according to claim 1 for preparing a fluid that contains size-controlled particles, wherein the matrix fluid comprises a reactive gas selected from the group consisting of $SiH_4$, $PH_3$, $B_2H_6$, $AsH_3$, $SiCl_2H_2$, $H_2$, HCl, $Cl_2$, HF, $F_2$, HBr, $Br_2$, HI, $NH_3$, $CH_4$, $C_2H_2$, $C_2H_4$, $C_2H_6$, $C_3H_8$, $C_4H_{10}$, NO, $NO_2$, $N_2O$, CO, and $O_2$.

20. The method according to claim 19 for preparing a fluid that contains size-controlled particles, wherein said reactive gas matrix fluid resides at a pressure higher than atmospheric pressure.

21. The method according to claim 19, wherein said matrix fluid comprises a liquid selected from the group consisting of water, hydrochloric acid, nitric acid, hydrogen fluoride, aqueous ammonia, hydrogen peroxide, acetic acid, sulfuric acid, phosphoric acid, hydrofluoric acid, ammonium fluoride solutions, propanol, acetone, ethanol, methanol, trichloroethylene, tetrachloroethylene, methyl ethyl ketone, toluene, xylene, trichloroethane, methyl iso-butyl ketone, hexamethyldisilazane, and dichloromethane.

22. The method according to claim 19, wherein the size distribution of the size-controlled particles essentially presents a single peak.

23. The method according to claim 19, wherein the size distribution of the size-controlled particles essentially presents a plural number of peaks.

24. The method according to claim 1 for preparing a fluid that contains size-controlled particles, wherein said matrix fluid comprises a liquid selected from the group consisting of water, hydrochloric acid, nitric acid, hydrogen fluoride, aqueous ammonia, hydrogen peroxide, acetic acid, sulfuric acid, phosphoric acid, hydrofluoric acid, ammonium fluoride solutions, propanol, acetone, ethanol, methanol, trichloroethylene, tetrachloroethylene, methyl ethyl ketone, toluene, xylene, trichloroethane, methyl iso-butyl ketone, hexamethyldisilazane, and dichloromethane.

25. The method according to claim 24, wherein the size distribution of the size-controlled particles essentially presents a single peak.

26. The method according to claim 24, wherein the size distribution of the size-controlled particles essentially presents a plural number of peaks.

27. Method according to claim 1 for preparing a fluid flow that contains size-controlled particles, wherein the size distribution of the size-controlled particles essentially presents a single peak.

28. Method according to claim 1 for preparing a fluid flow that contains size-controlled particles, wherein the size distribution of the size-controlled particles essentially presents a plural number of peaks.

29. A method for calibrating a particle measurement instrument which comprises employing the fluid prepared in claim 1 as a standard fluid for calibration purposes.

30. A method for testing the particle collection performance of a filter, which comprises employing the fluid prepared in claim 1 as a standard fluid for testing purposes.

* * * * *